United States Patent [19]

Stalherm et al.

[11] 4,263,100

[45] Apr. 21, 1981

[54] METHOD AND APPARATUS FOR REDUCING FINE DUST EMISSION WHILE CHARGING PREDRIED AND PREHEATED COAL INTO COKE OVENS

[75] Inventors: Dieter Stalherm; Janos Bocsanczy, both of Recklinghausen, Fed. Rep. of Germany

[73] Assignee: Firma Carl Still GmbH & Co. KG., Fed. Rep. of Germany

[21] Appl. No.: 77,199

[22] Filed: Sep. 20, 1979

[30] Foreign Application Priority Data

Sep. 29, 1978 [DE] Fed. Rep. of Germany ..... 2842477

[51] Int. Cl.[3] ..... C10B 53/04; C10B 53/08

[52] U.S. Cl. ..... 201/41; 201/6; 201/23; 202/82

[58] Field of Search ..... 201/6, 23, 41, 42, 44, 201/40; 202/81, 82, 150, 96

[56] References Cited

U.S. PATENT DOCUMENTS

| | | | |
|---|---|---|---|
| 3,992,266 | 11/1976 | Aktay et al. | 201/41 X |
| 4,139,419 | 2/1979 | Limberg | 201/41 X |
| 4,142,941 | 3/1979 | Weber et al. | 201/23 X |

FOREIGN PATENT DOCUMENTS

| | | | |
|---|---|---|---|
| 2647079 | 4/1978 | Fed. Rep. of Germany | 201/41 |
| 2659335 | 7/1978 | Fed. Rep. of Germany | 202/81 |

*Primary Examiner*—Joseph Scovronek

*Attorney, Agent, or Firm*—McGlew and Tuttle

[57] ABSTRACT

A method reducing fine dust emission during the time that predried and preheated coal is charged into coke ovens comprises directing wet coal to be carbonized into direct contact with a hot process gas so that the coal is transported dry and heated, directing the hot process gas with the heated coal to a plurality of different separators in succession with the first separator being set to separate only around from 80 to 90% of the total amount of the coal and without separating the fine dust, and a subsequent separator separate the remaining amount of the solid matter including the fine dust, compacting the dust removed from all of the separators and mixing them together, and charging the compacted mixed dust into the coke oven. The apparatus for effecting the invention includes a material separator which is designed as a gravity separator or gravity sifter which is arranged to discharge into a connection between the mixed and compacted dust separator in separate additional separators.

6 Claims, 1 Drawing Figure

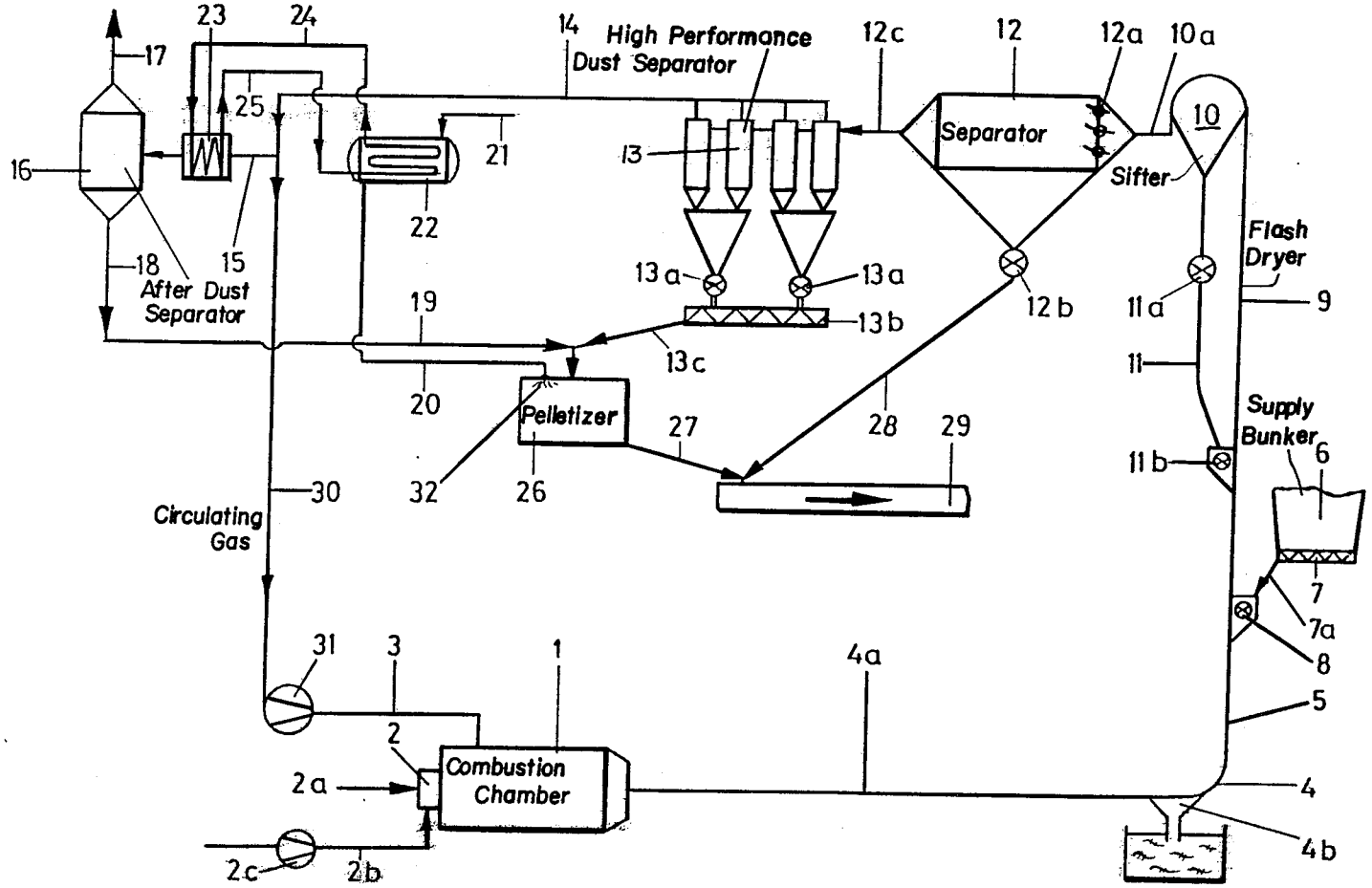
Flash Dryer
Supply Bunker
Sifter
Separator
High Performance Dust Separator
Pelletizer
Combustion Chamber
After Dust Separator
Circulating Gas

METHOD AND APPARATUS FOR REDUCING FINE DUST EMISSION WHILE CHARGING PREDRIED AND PREHEATED COAL INTO COKE OVENS

FIELD AND BACKGROUND OF THE INVENTION

This invention relates in general to coking and in particular to a new and useful method and apparatus for reducing fine coal emission during the time that predried and preheated coal is charged into coke ovens.

Installations for drying and preheating coal in flash driers prior to charging into coke ovens are known in the prior art.

To heat the coal fed into the preheating stage uniformly and rapidly, the coal must be relatively finely ground. Due to abrasion during this additional grinding operation and during the heating, a relatively high proportion of very fine coal is obtained in the coal mixture. Upon charging the preheated coal into the oven chambers, a portion of the very fine coal (up to 5% of the charge) passes with the charging gas into the collector main and then into the gas condensate-tar-water mixture (known in the art as "carryover") and makes the tar unusable for further processing, because of the high dust load.

Another difficulty connected with the charging of hot coal is that this freely flying dust escapes from the system through the smallest of leaks in the transfer areas and becomes a considerable environmental nuisance.

Numerous designs have already been provided in the past to prevent the finest coal dust from penetrating to the atmosphere and into the gas condensation system.

According to a prior art method (German OS No. 2,514,859), coal is wetted with 0.5 to 3% by weight of bituminous coal tar and then introduced into the ovens by pouring, with the tar containing about 3 to 7% of water and up to 1 weight percent of wetting agents. It is further provided that only the fine portion of the preheated coal is wetted with the tar and then blended with the main amount of preheated coal.

In a similar way, German AS No. 2,514,007 provides that 0.5 to 1 parts per mill of an aqueous 30 to 70% solution of an adhesive is admixed.

However, experience has shown that due to this so called admixture of additives, the bulk density of the coal as well as the quantity of the produced coke are reduced.It has further been found that with this method, emission at leaking spots during the transportation and charging of hot coal cannot be prevented.

Also, it is fairly difficult to admix the additives uniformly and, especially, to bind the fine dust to the coarser pieces.

In prior art, flash driers and coal preheaters, the heated coal is separated from the heating gases in a two-stage material separating system (usually cyclones) where the greatest part of about 95% of the total amount is separated in the first stage, and the remaining finer fractions of 4 to 4.5% in the second stage. Still before the heated gases leave the heater, the very finest dust is separated in a following electrostatic filter or wet scrubber.

The fundamental reason for this two-stage separation is that in the first stage, predominantly coarser fractions are separated, with the first stage being relatively amply dimensioned, so that the cyclone runs only at low speeds and wear is reduced. The second stage ordinarily comprises a plurality of cyclones connected in tandem or in parallel and having a small diameter, permitting a separation of the finer particles since the rotational speeds are high. Here, in spite of the high speeds, no wear is to be expected because of the small inertia of the fine particles.

Grain size analysis in various installations shows that the coal dust entrained into the gas condensation system does consist primarily of the finest particles, however, also of particles up to about one millimeter.

If now the grain size of the preheated coal is compared with that of the dust separated in the second stage, the following is found:

A complete analysis of the preheated coal reveals about 20% of a grain smaller than 0.1 millimeter.

An analysis of the dust separated in the second stage shows 100% of a particle size smaller than 0.05 millimeter, that is about 5% of the total amount.

In the first stage, despite the large size, already about 15% of the fine coal with a grain size smaller than 0.1 mm, and even the finest particles smaller than 20 microns are separated from the gas stream along with the coarse coal. This means that in the prior art systems it would be necessary to admix an additive, in accordance with German AS No. 2,514,007 or German OS No. 2,415,859, not only to the fine coal but also to the coarse coal, in order to satisfactorily bind the entire fine coal to the coarse fraction. This, however, is very expensive.

SUMMARY OF THE INVENTION

The invention is directed to a method of reducing the fine dust emission during the charging of coke ovens in which the preheated coal, particularly the fine dust, is pretreated in a suitable manner prior to charging it into the coke ovens, in order to prevent or reduce dust transfer into the collector main and, at the same time to prevent or reduce emission along the path of transportation and during the charging operation.

Accordingly, it is an object of the invention to provide a method of reducing fine dust emission during the time that predried and preheated coal is charged into coke ovens which comprises directed wet coal to be carbonized into direct contact with hot process gas so that the coal is transported, dried and heated, directing the heated coal and gases into a plurality of different separators with the first being set to separate only from around 80 to 90% of the total amount of the coal without separating the fine dust, and directing the coal through subsequent separators to separate the remaining amount of solid matter including the fine dust and compacting the dust removed from all of the separators and mixing them together and charging them into the coke oven.

A further object of the invention is to provide an apparatus for preheating and predrying coal and for separating the coal dust from the heavier solid matter and for separately pelletizing or compacting the dust and admixing it with the heavier solid matter and then directing it into the coke oven.

A particularly suitable preliminary separator for this purpose is a gravity separator or gravity sifter, since such an apparatus operates at very slow velocities of flow (2 to 5 meters per second), so that an entrainment of the finest particles is avoided to the largest extent and a most extensive separation of fine particles from the gases can be obtained. The efficiency of such a gravity separator is then dimensioned, in dependency on the nature of the coal, in such a way that only particles larger than 0.1 mm are separated and particles smaller than 0.1 mm pass through the separator. The particles smaller than 0.1 mm are separated, for the most part, in the second stage of the material separation and in the following gas purifying apparatus (electrostatic filter or wet scrubber), and then collected for further treatment.

According to the inventive method, this fine coal, up to 1 mm, representing about 20% of the total amount, can be compacted in a briquetting press with or without the admixture of a binder. Preferably, a pelletizer is employed for the compaction.

The compacting of fine coals to pellets with the addition of binders is particularly suitable since no high pressure is necessary for this purpose.

Crude tar or heavy oil have proved convenient binders for the pelletization, after they are heated up to 120° C. in order to make them sufficiently fluid while, at the same time, preventing the dust from cooling down.

The waste gas stream from the preheating stage may be utilized with a particular effectiveness if steam is used for heating the binder and keeping it hot, with the steam being produced from the waste gas stream having a temperature of about 280° to 300° C. by means of a steam generator.

Another advantage of the provided method is that under normal conditions, the finest dust in the coke ovens has a very low bulk density so that it not only hardly contributes to a further filling of interspaces in the coal charge but rather loosens up the charge, while, on the other hand, being compacted it effects a further increase in the bulk density of the charge, whereby the quality of the coke is improved.

In accordance with the invention, due to the absence of finest dust, emissions and carryover are substantially eliminated.

An object of the invention is to provide a method in which coal is separately preheated by a hot process gas and directed successively through a plurality of separators, wherein the fine dust is removed separately from the remaining solids and pelletized and then admixed with the solids and delivered to the coke oven.

A further object of the invention is to provide an apparatus for preparing coke for coke ovens which is simple in design, rugged in construction and economical to manufacture.

The various features of novely which characterize the invention are pointed out with particularity in the claims annexed to and forming a part of this disclosure. For a better understanding of the invention, its operating advantagesand specific objects attained by its uses, reference is made to the accompanying drawing and and descriptive matter in which a preferred embodiment of the invention is shown.

BRIEF DESCRIPTION OF THE DRAWINGS

The only FIGURE of the drawings is a schematic representation of a plan for charging coke to a coke oven constructed in accordance with the invention.

DESCRIPTION OF THE PREFERRED EMBODIMENT

Referring to the drawing, in particular the invention embodied therein comprises a method and apparatus for reducing the fine dust emission during the time that predried and preheated coal is charged into coke ovens. The combustion chamber for producing hot process gas is shown at 1. Any fuel may be used for heating the chamber. Further shown are a burner 2, a fuel supply line **2*a* and air supply line 2*b* containing a compressor 2*c*. Circulating gas is fed into combustion chamber 1 through a line 30, a circulation fan 31, and a line 3. The mixture of circulating gas and fresh produced combustion gas flows through a line 4*a* and a hot gas vent 4 to the material feed line or station 5. There, a supply bunker 6 for finely ground coke coal and a metering device 7 are provided. The coal is directed through a line 7*a* to a feeding centrifuge 8. The wet coal is centrifuged into a flash drier 9 and taken along upwardly by the gas stream. At 10, a sifter is shown which separates out the coarse grain coal. The sifter 10 is connected by a return line 11 to a star feeder 11*a* and a feeding centrifuge 11*b*. This equipment serves the purpose of recycling the coarse particles which did not attain the necessary temperature after having passed once through flash drier 9**, and to direct them one more therethrough, to further raise their temperature. The conveying gas has a temperature of about 650° to 700° C. and heats the coal up to about 200° to 250° C. at the end of the flash drier.

Through a line **10*a*, coal and conveying gas reach a material separator 12. In the present example, material separator 12 is designed as a gravity separator comprising a sifting device 12*a*. By setting the sifter device 12*a***, the separator can be adjusted to retain the major part of coarse particles, for example, those larger than 0.1 mm, which may represent about 80% of the total amount, while the fine fraction smaller than 0.1 mm passes through the separator.

The fine coal dust not precipitated in material separator 12 passes along with the conveying gas through a line **12*c* to a high-performance dust separator 13 comprising a battery of parallel-connected cyclones of smaller diameter. The process gas which is now cooled down and loaded with only a small amount of coal dust but with the entire moisture of the total amount of coal, is discharged trough a line 14 and has still a temperature of about 280° to 300° C. A portion of this gas stream is returned through a pipe 30 to circulation fan 31 whereby the cycle of the process gas is closed. The gas portion which is not circulated passes through a branch line 15 into an after-dust separator 16 wherefrom coal dust is removed through a line 18. The purified waste gas is discharged through a stack 17** into the atmosphere.

The fine coal which is separated in the high-performance dust separator 13 is directed through star feeders **13*a*, and a collecting conveyor 13*b* into a line 13*c* and united with the coal dust coming through line 18 and 19 from after-separator 16 and directed into a pelletizer 26. There, the coal dust is sprayed with an additive, heated to 120° C. and formed into pellets. The additiveis supplied to a line 21 and into a container 22 where it is heated to about 120° C. and wherefrom it is fed through a line 20 and spray nozzle 32 into the pelletizer. The container 22 for the additivie is heated with steam. The steam is produced in a heat exchanger 23 by utilizing the heat from the process gases cooled down to about 300° C., and circulated through lines 24, 25. The formed pellets are removed through a line 27, blended with the hot coal coming through star feeder 12*b* and line 28 from material separator 12, and transported by a conveying means 29** to the bunker system of the coke oven battery (not shown).

While a specific embodiment of the invention has been shown and described in detail to illustrate the application of the principles of the invention, it will be understood that the invention may be embodied otherwise without departing from such principles. What isclaimed is:

1. In combination with a process of predrying wet coal, to be charged into a coking chamber, of the type wherein the wet coal is directly contacted with a hot process gas which tranports, predries and preheats the coal, wherein the predried and preheated coal is separated from the gas, and in which the separated coal is then charged into the coking chamber, the improved method of reducing the amount of fine dust in the separated gas as well as fine dust carryover comprising first separating only 80 to 90 percent of the coal from the gas without separating the fine dust therefrom, then separating fine dust and the remaining coal from the gas, then compacting said separated fine dust and the remaining coal to form a compacted material, and admixing the compacted material with said first separated coal and charging said admixture into the coking chamber.

2. The improved method as set forth in claim 1, further comprising heating one of crude tar and heavy oil to a temperature of more than 120° C., and adding said heated one of crude tar and heavy oil to said separated fine dust and the remaining coal.

3. The improved method as set forth in claim 2, further comprising indirectly generating steam from the heat of said separated gas, and indirectly heating said one of crude tar and heavy oil with said steam.

4. The improved method as set forth in claim 3, further comprising indirectly generating hot steam with the gas having a temperature of from about 280° to 300° C., indirectly heating one of crude tar and heavy oil with the hot steam, and then adding said one of crude tar and heavy oil to said separated fine dust and remaining coal.

5. In combination with an arrangement for predrying and preheating wet coal to be coked in a coking oven and having means for generating a high temperature process gas, means for mixing the wet coal with the process gas for predrying and preheating the wet coal, separator means connected to the predrying and preheating means for separating the gas from the predried and preheated coal, and means for conveying the predried and preheated coal to the coking oven, the improvement wherein the separator means includes a gravity separator for removing only 80 to 90 percent of the coal from the gas without separating the fine dust therefrom, subsequent separators connected to said gravity separator downstream thereof operable to separate the remaining solid matter including the fine dust, a pelletizer connected to each of said subsequent separators for receiving and pelletizing said remaining solid matter including the fine dust to form a pelletized material, means for admixing said pelletized material and said coal separated insaid gravity separator operatively connected to the conveying means.

6. The improvement, as set forth in claim 5, further comprising means, operatively connected to said pelletizer, for admitting a binder thereto.

* * * * *

Notice of Adverse Decision in Interference

In Interference No. 100,938, involving Patent No. 4,263,100, D. Stalherm and J. Bocsanczy, METHOD AND APPARATUS FOR REDUCING FINE DUST EMISSION WHILE CHARGING PREDRIED AND PREHEATED COAL INTO COKE OVENS, final judgment adverse to the patentees was rendered Apr. 14, 1983, as to claims 1, 5 and 6.

[*Official Gazette July 12, 1983.*]